US005228505A

United States Patent [19]

Dempsey

[11] Patent Number: 5,228,505

[45] Date of Patent: Jul. 20, 1993

[54] SHELL AND COIL HEAT EXCHANGER

[75] Inventor: Jack C. Dempsey, Brown City, Mich.

[73] Assignee: Aqua Systems Inc., Brown City, Mich.

[21] Appl. No.: 837,283

[22] Filed: Feb. 18, 1992

Related U.S. Application Data

[60] Division of Ser. No. 649,376, Jan. 31, 1991, Pat. No. 5,088,192, which is a continuation of Ser. No. 339,390, Apr. 17, 1989, abandoned.

[51] Int. Cl.[5] ..... F28D 7/04

[52] U.S. Cl. ..... 165/140; 165/160; 165/163; 62/238.6

[58] Field of Search ..... 165/163, 160, 140

[56] References Cited

U.S. PATENT DOCUMENTS

| | | | |
|---|---|---|---|
| 2,360,408 | 10/1944 | Dunn et al. | 165/140 |
| 2,888,251 | 5/1959 | Dalin | 165/163 |
| 4,402,359 | 9/1983 | Carnaous et al. | 165/179 |
| 4,556,103 | 12/1985 | Kuwa et al. | 165/900 |

FOREIGN PATENT DOCUMENTS

| | | | |
|---|---|---|---|
| 2495754 | 6/1982 | France | 165/140 |
| 161484 | 10/1982 | Japan | 165/163 |
| 225295 | 12/1984 | Japan | 165/163 |

*Primary Examiner*—Albert W. Davis, Jr.
*Attorney, Agent, or Firm*—Brooks & Kushman

[57] ABSTRACT

The heat exchanger is made up of a shell having a coaxial tubular outer and inner wall with end plates attached thereto to enclose a tubular shell cavity provided with an inlet and outlet for a first fluid. Within the shell cavity is a spiral coil of tubing through which flows a second fluid. The coil is wound helically about the axis of the shell and sized to fit the inner and outer walls with limited radial clearance. The coils are axially spaced from one another to define a spiral flow path within the shell cavity for the fluids to first flow. The radial and axial clearance establish a spiral flow path and an axial flow path which are relatively sized to cause the first fluid to travel in a spiral motion, thereby enhancing heat transfer between the first and second fluids.

8 Claims, 5 Drawing Sheets

SHELL AND COIL HEAT EXCHANGER

This application is a division of Ser. No. 649,376 filed Jan. 31, 1991, now U.S. Pat. No. 5,088,192, which is a continuation of Ser. No. 339,390 filed Apr. 17, 1989, now abandoned.

FIELD OF INVENTION

This invention relates to heat exchangers and more specifically shell and coil heat exchangers for transferring heat between two fluids.

BACKGROUND OF INVENTION

Heat exchangers of a shell and coil design have been used for many years in a variety of applications where it is desired to transfer energy between two fluids. Shell and coil heat exchangers are frequently used in refrigeration systems and heat pumps. Shell and coil heat exchangers can be fabricated into a compact unit capable of withstanding relatively high pressure.

Shell and coil heat exchangers are typically mounted vertically, i.e., the axis about which the coil is wound is perpendicular to the ground. With a vertical shell when you have a gas vapor mixture, the gas will tend to accumulate at the top with the shell and the liquid will accumulate at the bottom. The flow of the fluid in the shell is generally axial flowing from one end to the other and circulating about the coils of tubing within the shell cavity.

In order to minimize the volume within the shell a central tubular insert may be provided which falls within the helical coil. This is particularly useful in refrigeration systems and heat pumps so that the quantity of refrigerant may be minimized. Example of a shell and coil heat exchanger having an inner shell to minimize shell cavity volume is shown in U.S. Pat. No. 2,668,692 and companion U.S. Pat. No. 2,668,420. In spite of the inner shell, a significant disadvantage of the shell heat exchangers are the large volume of the shell cavity relative to the volume of the liquid within the coiled tubing.

SUMMARY AND OBJECT OF THE INVENTION

The object of the invention is to achieve maximum heat transfer rate and overall efficiency while minimizing the size of the shell and coil.

Another object of the invention is to minimize the volume of fluid within the shell and coil cavities.

Another object of the invention is to develop a heat exchanger which performs satisfactorily in both the vertical and horizontal positions.

The present invention is directed to a heat exchanger and method of forming same. The heat exchanger is made up of a shell which has a coaxial tubular outer and inner wall with end plates attached thereto to enclose a tubular shell cavity provided with an inlet and outlet for a first fluid. Within the shell cavity is a spiral coil tubing would helically about the axis of the shell and sized to fit between the inner and outer shell walls with limited radial clearance. The spiral coil is provided with a plurality of windings axially spaced from one another to define a spiral flow path within the shell cavity for the first fluid. The radial clearance between the spiral coil and shell inner and outer walls is sized such that the first fluid travels in a spiral motion to enhance the heat transfer between the first fluid and the shell cavity and a second fluid flowing within the spiral coil. A dual spiral helical coil assembly for use in the heat exchanger may be manufactured using a method made up of the following steps: Winding a first tube spirally about a mandrel having a large diameter region and a small diameter region. Winding a second tube spirally in a similar manner, both tubes having an axial spacing between windings. The first and second coils are then interwound so that the small diameter region of each coil is nested within the large diameter region of the opposite coil. The two coils are then depressed axially to deform the coils into a small compact unit with reduced axial spacing between the windings.

The principal advantage of the invention is that the heat exchanger has a low enough shell volume so that it works very efficiently in a reverse flow heat pump having a heating and cooling cycle. Another advantage of the invention is that the fluid within the shell flows in a substantially spiral path so that true counterflow can be achieved resulting in maximum heat transfer.

BRIEF DESCRIPTION OF THE PREFERRED EMBODIMENT

Figure 1:
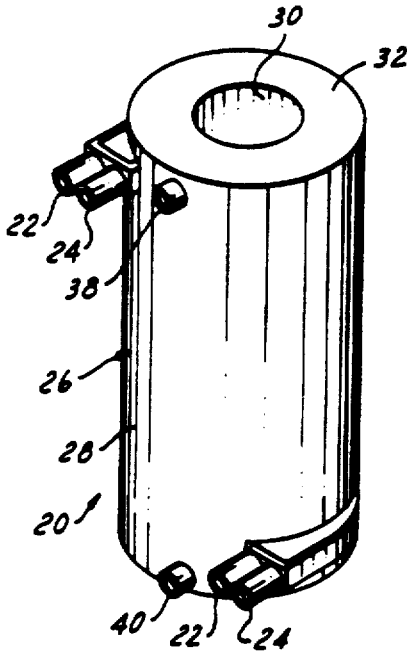
FIG. 1 is a perspective view of the heat exchanger.
Figure 2:
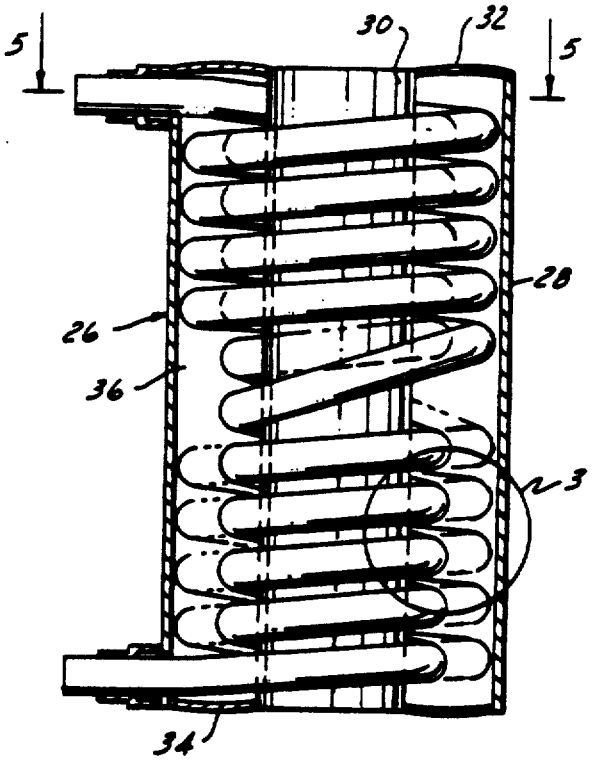
FIG. 2 is a side elevation of the heat exchanger with a portion of the shell cut away.

With reference to the drawings three preferred embodiments of the heat exchanger will be described in detail as well as a method of forming a helical coil.

Embodiment 1

A first embodiment of the heat exchanger is shown in FIGS. 1 through 5. The heat exchanger 20 is provided with a pair of spiral coils of tubing 22 and 24 and the shell assembly 26 made up of the outer tubular wall 28, inner tubular wall 30 and first and second end plates 32 and 34. Shell assembly 26 encloses a tubular shell cavity 36 which is symetrical about the axis of the heat exchanger assembly. At the upper end of the shell assembly is a first inlet-outlet fitting 38 and at the opposite end of the shell assembly is the second inlet-outlet fitting 40. Each fitting 38 and 40 communicate with the shell cavity 36 and provide means for admitting and means for removing a first fluid from the shell cavity. Which fitting acts as an inlet and which fitting acts as an outlet will vary depending on the application or the mode of operation in the case of the reverse cycle heat pump where the direction of flow may vary depending on whether the unit is heating or cooling.

Figure 4:
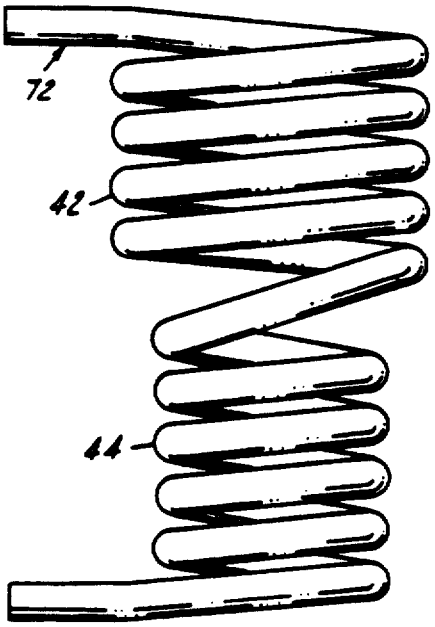
FIG. 4 is a side elevation of a spiral coil.
Figure 3:
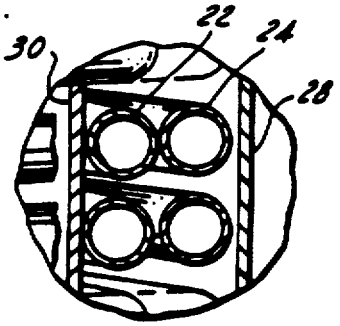
FIG. 3 is a fragmentary cross-sectional view of a portion of the heat exchanger.

Within the shell cavity lies the first and second spiral coils 22 and 24. Second spiral coil 24 is shown in dotted lines in FIG. 2 so the two coils may be distinguished. Both coils are similar shape as shown in FIG. 4. Each has a large diameter region 42 and a small diameter region 44 both of which are helically would about the center axis of the heat exchanger assembly. The small diameter section of each coil is located within the large diameter section of the opposite coil so that the two coils are nested together to form a compact assembly.

The small diameter section of the coil fits relatively closely to the inner tubular wall 30 of the shell assembly and the outer periphery of the large diameter of the coil fits relatively close to the outer tubular wall 28 of the shell assembly. Each of the spiral coils has a plurality of windings located generally adjacent a corresponding winding in the opposing coil so that the combined radial dimension of the two windings substantially occupy the space of the cavity between the inner and outer walls. The radial clearance between the inner and outer wall and the pair of coiled windings is carefully controlled to restrict the flow of a first fluid flowing through the shell cavity. The axial spacing of the coil windings is also very carefully controlled to define a spiral flow path within the shell cavity for the first fluid. The radial clearance and axial spacing of the coils and the shell cavity are relatively sized so that the first fluid within the shell cavity travels in a spiral motion to enhance the heat transfer between the first fluid within the shell cavity and the second fluid traveling within the coils.

Two spiral coils of tubing are used in the first embodiment shown in FIG. 1–5 in order to maximize the surface to volume ratio as two tubes with a given total cross-sectional area having much greater wall area than a single tube of equal cross-sectional area. In typical operation the inlets and outlets of coils 22 and 24 will be connected together with a "Y"-shaped yoke to provide a single input and a single output. Copper has been found to be a preferred material for the spiral coils. Ideally, the copper tubing will have its periphery knurled and its internal surfaces rifled so that the surface area can be increased. A tube having augmented wall surface of this design is described in detail in U.S. Pat. No. 4,402,359 which is incorporated herein by reference. Tubing with knurled exterior and rifled interior is commercially available from Noranda Metal Industries, Inc. of Newton, Conn. The tube having a knurled exterior is particularly advantageous in the present invention in that when a coil contacts an adjacent coil or the wall of the shell flow is not completely obstructed in the axial direction since fluid can flow between the raised knurled protrusions thereby most effectively using the entire heat transfer surface of the tubing. Alternatively, S/T TRUEFIN®, an augmented finned tube made by Wolverine, P.O. Box 2202, Decatur, Ala. 35602, may be used to form the coils.

Figure 20:
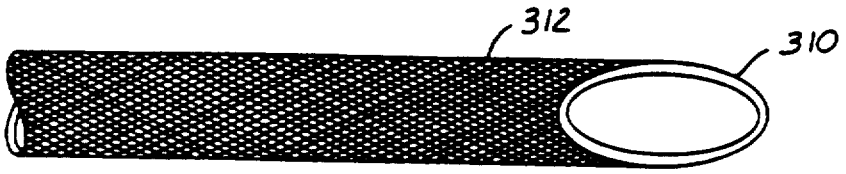
FIG. 20 is a perspective view of an augmented tube.

Referring to FIG. 20, there is shown a heat transfer tube 310 having a plurality of integral radially extending pyramid-fins 312 formed in its outer surface. The density of the pyramid-fins is between 80 and 500 pyramid-fins per square inch and the height of the pyramid-fins is between 0.015 inch for a pyramid-fin density of 500 pyramid-fins per square inch and 0.040 inch for a pyramid-fin density of 80 pyramid-fins per square inch. The series of threads intersecting each other at 60° so as to form a herringbone or diamond pattern. The threads are in the range of 12 to 30 TPI, preferably about 20 TPI. The height of the pyramid-fins formed is between about 0.037 in at 12 TPI and about 0.015 in at 30 TPI. The preferred height of the pyramid-fins is about 0.022 in at 20 TPI.

Figure 21:
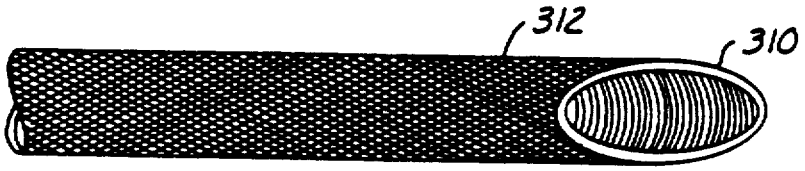
FIG. 21 is an alternative form of an augmented tube shown in FIG. 20.
Figure 22:
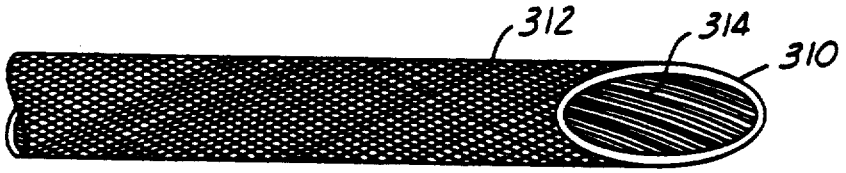
FIG. 22 is another alternative view of the augmented tube shown in FIG. 20.

When the pyramid-fins are formed on a tube of relatively small thickness, the heat transfer enhancement pattern will extend through the thickness of the tube wall, as shown in FIG. 21, so at to form a doubly augmented tube. If the tube wall is thick enough, or if a smooth mandrel is placed inside the tube during formation of the external heat transfer enhancement pattern, then the inside of the tube will remain smooth. The inside of the tube may then be provided with internal fins 314, such as shown in FIG. 22 of the drawings. These fins may be formed prior to making the outside pyramid-fins or at the same time by pressing the tube during knurling onto a mandrel placed inside the tube and having suitable grooves for forming the fins. The helix angle of the internal fins is between 0° and 90°, preferably between 15° and 45° with respect to the longitudinal axis of the tube.

Figure 5:
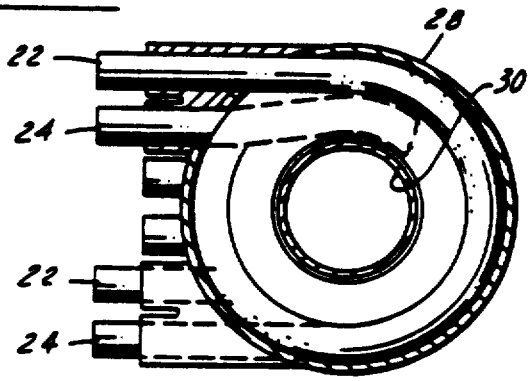
FIG. 5 is a top view of the heat exchanger with the top end cut away.
Figure 6:
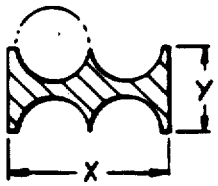
FIG. 6 is a diagram of the sprial flow path of the heat exchanger in the first embodiment of the invention.

FIG. 6 shows a sectional view of the spiral flow path formed between the tubes and inner and outer shell walls. The axial spacing of the tube coils is shown as dimension Y and the spacing between the inner and outer shell walls is shown as dimension X. The cross-hatched area defining the spiral flow path is an area equal to X times Y minus twice the tube area, i.e., $X * Y - \pi DT^2/2$ where DT equals the tube diameter. The minimum axial flow area in the shell is equal to the area of the shell minus the area of the tubes in the plane view. As shown in FIG. 5 the axial flow path consists of three small circular paths. The clearance between the two tubes and between the tubes and shell wall is shown enlarged in FIGS. 3 and 5 for ease in understanding. The actual axial clearance between the coils and the wall may be 0.005 inches or less, therefore, the axial flow area can be approximated by multiplying the axial clearance times the perimeter of each of the circular flow paths so that the minimum axial flow area will equal $Ax*3\pi/2(D1+D2)$ where D1 equals the outer diameter of the inner tubular wall, D2 equals the inner diameter of the outer tube wall and AX equals the axial clearance. The actual axial clearance may be slightly greater than that described by the preceding equation since the outer periphery of the coil is knurled or finned thereby giving it a slightly smaller effective diameter than that measured across the outside diameter of the tube. In Example 4 below, the calculated axial clearance is zero since the tubes fit line to line within the shell. Even in that extremely tight example there will be some axial flow between the knurls or fins thereby allowing effective utilization of the entire tube surface area.

In order to achieve a significant spiral flow path for the first fluid in the shell cavity, the axial flow area should not exceed that of the spiral flow path as previously calculated. The relationship between the actual flow area and the spiral flow path can be quantified by an axial clearance ratio which is equal to the axial flow path divided by the spiral flow path area. It is therefore desirable to have an axial clearance ratio below one hundred percent. It is preferred that the axial clearance ratio be maintained below sixty percent. The most preferred axial clearance ratio be between zero to sixty percent depending upon the specific application for the heat exchanger unit. Note that even with the zero axial clearance ratio as previously calculated, there will be some axial flow due to the knurling of the coil tubing. The following examples represent possible heat exchanger embodiments, the first of which has been tested and performed quite satisfactorily.

EXAMPLE 1

| Example 1 | |
|---|---|
| Coil Design | Type I |
| X | 1.515 |
| Y | .9375 |
| DT | .750 |
| Spiral Flow Path Area | |
| $X*Y-\pi DT^2/2=$ | .537 |
| $D_1$ | 6.000 |
| $D_2$ | 2.970 |
| Axial Clearance (AX) | .005 |
| Axial Clearance Area | |
| $\pi AX(D_1 + D_2)3/2$ | .211 |
| Axial Clearance Ratio | 39% |

EXAMPLE 2

| Example 2 | |
|---|---|
| Coil Design | Type I |
| X | 1.5195 |
| Y | .9375 |
| DT | .750 |
| Spiral Flow Path Area | |
| $X*Y-\pi DT^2/2=$ | .542 |
| $D_1$ | 6.000 |
| $D_2$ | 2.961 |
| Axial Clearance (AX) | .0075 |
| Axial Clearance Area | |
| $\pi AX(D_1 + D_2)3/2$ | .317 |
| Axial Clearance Ratio | 58% |

EXAMPLE 3

| Example 3 | |
|---|---|
| Coil Design | Type I |
| X | 1.512 |
| Y | .9375 |

-continued

| Example 3 | |
|---|---|
| Coil Design | Type I |
| DT | .750 |
| Spiral Flow Path Area | |
| $X*Y-\pi DT^2/2=$ | .535 |
| $D_1$ | 6.000 |
| $D_2$ | 2.978 |
| Axial Clearance (AX) | .004 |
| Axial Clearance Area | |
| $\pi AX(D_1 + D_2)3/2$ | .169 |
| Axial Clearance Ratio | 32% |

EXAMPLE 4

| Example 4 | |
|---|---|
| Coil Design | Type I |
| X | 1.50 |
| Y | .9375 |
| DT | .750 |
| Spiral Flow Path Area | |
| $X*Y-\pi DT^2/2=$ | .523 |
| $D_1$ | 6.00 |
| $D_2$ | 3.00 |
| Axial Clearance (AX) | 0 |
| Axial Clearance Area | |
| $\pi AX(D_1 + D_2)3/2$ | 0 |
| Axial Clearance Ratio | 0 |

Use of Heat Exchanger in Dual Mode Heat Pump

Figure 7:
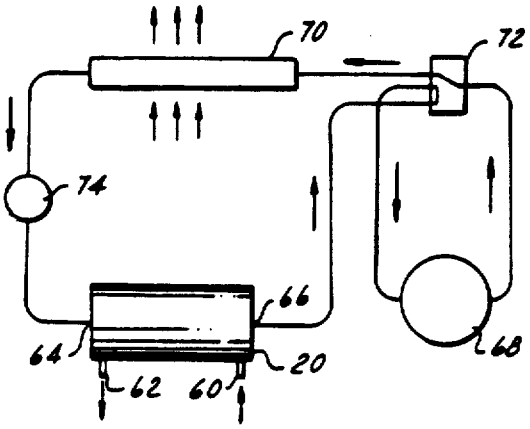
FIG. 7 is a block diagram of a heat pump in the heating mode.
Figure 8:
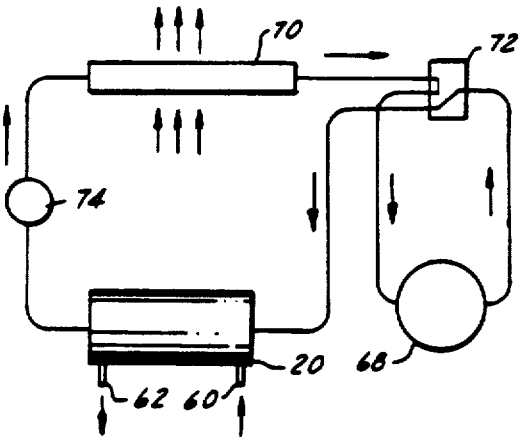
FIG. 8 is a block diagram of a heat pump in the cooling mode.

The heat exchanger described of the first embodiment works quite satisfactorily in a water source heat pump which can be used for both heating and cooling. A schematic diagram of a heat pump in the heating mode and the cooling mode are shown in FIGS. 7 and 8 respectively. The heat exchanger is depicted by box 20 and is provided with water inlet 60 and water outlet 62. The water circulates through the tubular coil in the heat exchanger unit. In the shell of the heat exchanger is circulated a refrigerant such as Freon® 22. In the heating mode, refrigerant enters in the outlet 64 and exits the shell cavity through inlet/outlet 66 as the refrigerant circulates in the direction of the arrows. The refrigerant is circulated by pump 68 which circulates the Freon® in a closed loop path through tube and shell heat exchanger 20, tube and fin heat exchanger 70. Heat exchanger 70 transmits energy between the Freon® and air which is circulated through the heat exchanger by a blower which is not shown in the heating mode and reversing valve 72 and is oriented out that the output of the pump is connected to the tubing vent heat exchanger 70 and the suction side of the pump is connected to a shell and coil heat exchanger 20.

In the heating mode the shell and coil heat exchanger acts as an evaporater and the tube and fin heat exchanger 70 acts as a condenser. The hot high pressure output of pump 68 flows to tube and fin heat exchanger 70 and is cooled by the flow of air therethrough. Pressure is maintained relatively high and the tube and fin exchanger 70 by expansion valve 74. When the refrigerant flows through expansion valve 74, pressure drops substantially. As a low pressure refrigerant flows into the heat exchanger 20, it absorbs heat from the water circulating through the coils and evaporates. Refrigerant exits the heat exchanger through outlet 66 and passes through reversing valve 72 to the inlet of pump 60 to complete the heating cycle.

Pump 60 is driven by conventional mechanical means such as an electrical motor. Since heat energy is being added or removed from the water circulating through the coil of the heat exchanger, the energy output to the air substantially exceeds the energy consumed by the pump 68 in the heating and cooling modes. In the cooling mode, the reversing valve switches as shown in FIG. 8 so the suction side of the pump is connected to the tube and fin heat exchanger 70 and the outlet of the pump is connected to the shell and coil heat exchanger 20. In the cooling mode the heat exchanger 20 acts as a condenser. The water circulating through the coil cools the refrigerant circulating through the shell cavity. The refrigerant flows through expansion valve 74 and evaporates in the tube and fin heat exchanger 74 to cool the air flowing therethrough.

It has been determined that the heat exchanger of the present design performs quite well in a reverse cycle water source heat pump and is capable of achieving very high efficiency levels in both the heating and cooling modes. Previous heat pump designs tended to optimize performance in one mode that was used most frequently and accepting a lower coefficient of performance in the lesser used mode.

Embodiment II

Figure 9:
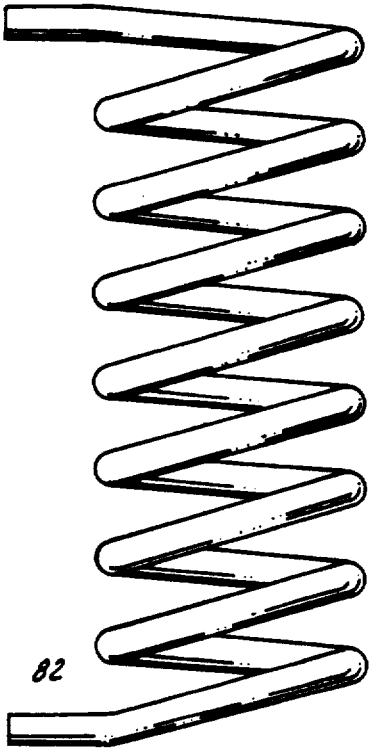
FIG. 9 is a spiral coil from an alternative embodiment of the invention.
Figure 10:
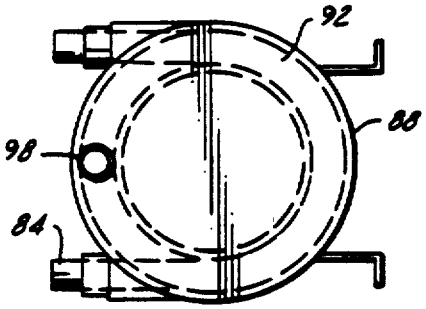
FIG. 10 is a top view of an alternative embodiment of the invention.
Figure 11:
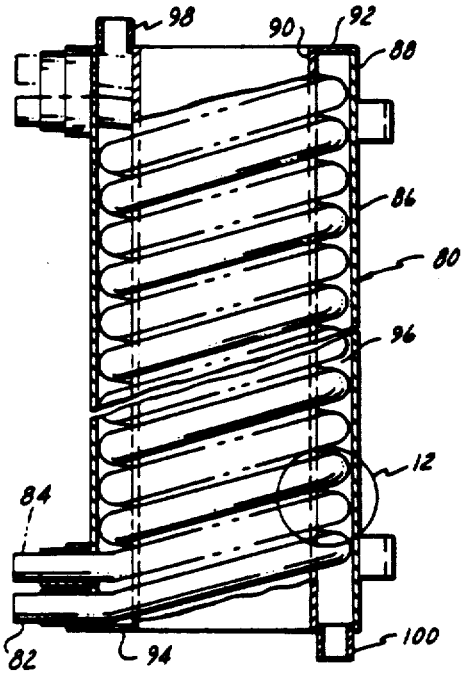
FIG. 11 is a side view of an internal embodiment of the invention with a portion of the shell cut away.

An alternative embodiment of the heat exchanger is shown in FIGS. 9 through 13. In the second embodiment the heat exchanger assembly 80 is provided with a first and second spiral coil 82 and 84 helically wound about a central axis and having a constant uniform diameter. The two coils are interwoven like a double lead screw as shown in FIG. 11. Each of the individual coils has substantial axial spacing between the plurality of windings as shown in FIG. 9. The coils are identical in structure. The shell assembly 86 is made up of an outer tubular wall 88 and an inner tubular shell wall 90 which are connected by first and second and plates 92 and 94 to define a shell cavity 96. A shell cavity is provided with a first and second inlet/outlet fitting 98 and 100 at opposite ends of the shell cavity.

Figure 12:
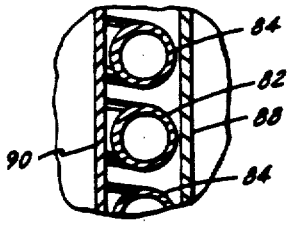
FIG. 12 is an enlarged fragmentary cross-sectional view of the second embodiment of the invention.
Figure 13:
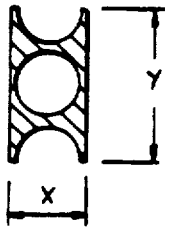
FIG. 13 is a diagram of the spiral flow path of the heat exchanger in the second embodiment of the invention.

A fragmentary cross-sectional side view of a portion of the heat exchanger assembly is shown in FIG. 12. The inner and outer walls of the shell 90 and 88 are spaced apart by a distance slightly greater than the diameter of the coils 82 and 84 thereby providing axial clearance for the flow of the first fluid in the heat exchanger shell. In FIG. 11 coil 84 is drawn in dotted lines to more clearly show that each coil winding is positioned between the windings of the other coil. The spiral flow path in the second embodiment of the invention is shown in FIG. 13. Note dimension wide the distance between the coil windings represents the distance between two windings of the same coil. The equasion defining the spiral flow area is the same for the second embodiment as it is for the first. The spiral flow area equals X times Y minus $DT^2/2$. The minimum axial flow area is equal to the axial clearance between the tube and shell wall times the total clearance area length, i.e., axial clearance area equals pi times axial clearance times (D1+D2)3/2. The following are examples of potential designs for heat exchangers of the type shown in the second preferred embodiment:

EXAMPLE 5

| Example 5 | |
|---|---|
| Coil Design | Type II |
| X | .760 |
| Y | 1.6875 |
| DT | .750 |
| Spiral Flow Path Area | |
| $X*Y-\pi DT^2/2=$ | .400in$^2$ |
| $D_1$ | 6.000 |
| $D_2$ | 4.480 |
| Axial Clearance (AX) | .005 |
| Axial Clearance Area | |
| $\pi AX(D_1 + D_2)3/2$ | .165 |
| Axial Clearance Ratio | 41% |

EXAMPLE 6

| Example 6 | |
|---|---|
| Coil Design | Type II |
| X | .763 |
| Y | 1.6875 |
| DT | .750 |
| Spiral Flow Path Area | |
| $X*Y-\pi DT^2/2=$ | .405 |
| $D_1$ | 6.000 |
| $D_2$ | 4.477 |
| Axial Clearance (AX) | .0065 |
| Axial Clearance Area | |
| $\pi AX(D_1 + D_2)3/2$ | .208 |
| Axial Clearance Ratio | 51% |

EXAMPLE 7

| Example 7 | |
|---|---|
| Coil Design | Type II |
| X | .758 |
| Y | 1.6875 |
| DT | .750 |
| Spiral Flow Path Area | |
| $X*Y-\pi DT^2/2=$ | .396 |
| $D_1$ | 6.000 |
| $D_2$ | 4.484 |
| Axial Clearance (AX) | .004 |
| Axial Clearance Area | |
| $\pi AX(D_1 + D_2)3/2$ | .128 |
| Axial Clearance Ratio | 32% |

EXAMPLE 8

| Example 8 | |
|---|---|
| Coil Design | Type II |
| X | .760 |
| Y | 1.6875 |
| DT | .750 |
| Spiral Flow Path Area | |
| $X*Y-\pi DT^2/2=$ | .400 |
| $D_1$ | 6.00 |
| $D_2$ | 4.50 |
| Axial Clearance (AX) | 0 |
| Axial Clearance Area | |
| $\pi AX(D_1 + D_2)3/2$ | 0 |
| Axial Clearance Ratio | 0 |

Method of Winding a Coil and Forming Heat Exchanger

Figure 14:
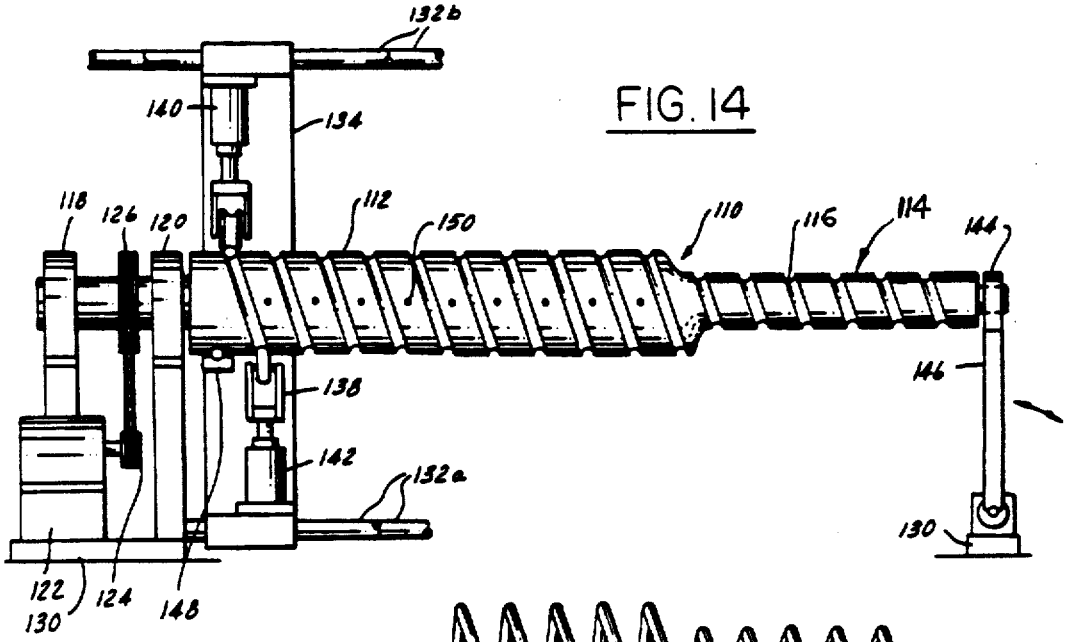
FIG. 14 is a side elevation of an apparatus for forming a spiral coil used in the first embodiment of the invention.

FIG. 14 shows a diagram of a mechanism specifically designed for winding heat exchanger coils. The apparatus has a central mandrel 110 having a large diameter section 112 and a small diameter section 114. The mandrel is provided with a helical semi-circular groove having the same large and small diameter and the same number of turns to get the coil employed in the first embodiment of the invention as shown in FIG. 4. The axial spacing between the grooves where the pitch of the spiral on the mandrel is significantly greater than the finished coil shown in FIG. 4. The semi-circular groove 116 corresponds in diameter in the tube size to be formed into a coil.

Mandrel 110 is pivotably supported on one end by bearings 118 and 120. The mandrel is driven by hydraulic motor 122 which is coupled to the mandrel by sprockets 124 and 126 and chain 128. Bearings 118 and 120 and the hydraulic motor 122 are affixed to an assembly 130. Affixed to frame 130 are guide rods 132(*a*) and 132(*b*) preferably four parallel guide rods are parallel to the axis of the mandrel 110. Sliding axially along the guide rods is subframe 134 which is shown in its left most position in FIG. 14. Mounted on subframe 134 is guide roll 136 and 138 which are pivotably mounted on the ends of hydraulic cylinders 140 and 142. The small end of the mandrel 110 is privotably supported by the bearing 144 which is affixed to the end of the link 146. Link 146 is pivotably affixed to frame 130 so that it can be hinged into and out of cooperation with the mandrel 110 as shown by the arrow in FIG. 14.

Prior to the bending of a coil, a straight length of copper tube of sufficient length to form a coil is selected and filled with sand. The ends of the tube are capped to prevent the sand from escaping. The sand prevents the tube from kinking or collapsing during the bending process. With some thick wall tubing sand is not required. Hydraulic cylinders 140 and 142 are not fully retracted so that guide rollers 136 and 138 are in contact with the mandrel. In the embodiment shown the mandrel would be rotated 180° so that clamp 148 would be on the top of the mandrel. One end of the tube would then be affixed to the mandrel with clamp 148 so that the clamp would be lying in a semi-circular helical group 116. Hydraulic cylinders 140 and 142 would then be pressurized causing the guide rollers to come in contact with the mandrel. Note that guide roller 136 is provided with a semi-circular groove to cooperate with a tube to be bent. The load exerted by hydraulic cylinders 140 and 142 is substantially equal so that there is minimal bending force exerted on the mandrel. With the tube clamped in place and the guide rolls in position, hydraulic motor 122 is activated to cause the mandrel to rotate counter-clockwise when viewed from the end adjacent the hydraulic motor. As the mandrel rotates the entire subframe assembly 134 with the guide rolls and hydraulic cylinders mounted thereon moves to the right in FIG. 14 traversing the length of the mandrel. As the subframe reached the transition from the large mandrel end 112 to the small mandrel end 114 the hydraulic cylinders 140 and 142 maintain the guide rolls in constant contact with the mandrel.

Figure 15:
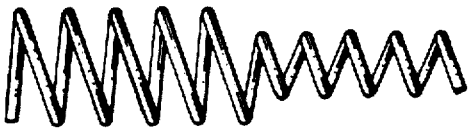
FIG. 15 is a spiral coil prior to compression.

When the desired number of windings have been made, the hydraulic motor stops, hydraulic cylinders are retracted and link 146 is pivoted clockwise out of the way. Clamp 148 is holding the coil in place is removed and the hydraulic motor is run with the coil restrained from turning so that the formed coil is screwed off of the mandrel. The formed coil as shown in FIG. 15 is substantially longer than ultimately desired and the axial spacing between the windings is large. The ends of the coil is then uncapped and the sand removed. A second coil is then formed in the identical manner so that the two coils are placed end to end with the small ends of each coil-in contact with one another. The one coil is then rotated so that the two coils threadingly interweave with one another so that the small end of one coil become located entirely within the large end of the opposite coil and vise versa.

Figure 16:
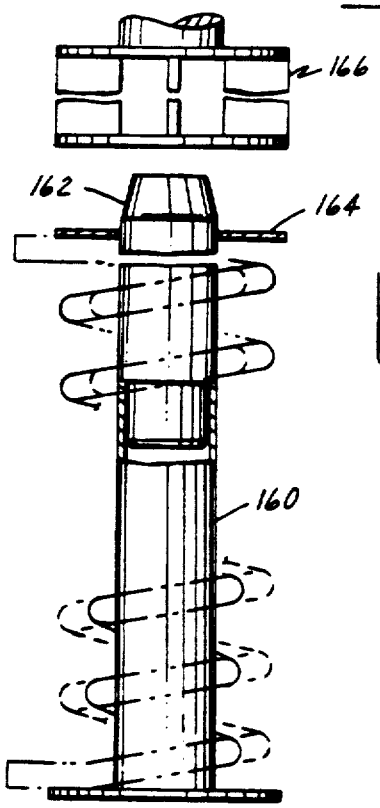
FIG. 16 is an exploded view of the apparatus for compressing a spiral coil assembly.

With the two coils oriented in nested relationship with one another as previously described, they are then pressed to the the desired final length using a fixture shown in FIG. 16. The inner shell tubular wall is cut to length and welded to the lower end plate to form inner tube end plate assembly 160. Assembly 160 is placed on a flat surface and guide mandrel 162 is telescopingly inserted therein. The lower end of guide mandrel has a cylindrical section to fit into the inside diameter of assembly 160 and the opposite end of guide mandrel is conically tapered. The inner tube end plate assembly with the guide mandrel installed has an overall length in excess of the length of the coil spring prior to compression. A coil spring pair interwoven as previously described in placed over the guide mandrel top plate 164 is placed thereon and compressed by Ram 166 using a conventional press (not shown). When the top plate 164 has been pressed to the inner tube end plate assembly, the top plate is then tack welded to the inner tube then the ram and the guide mandrel are removed so that the weld can be completed resulting in a spool-like assembly.

Figure 17:
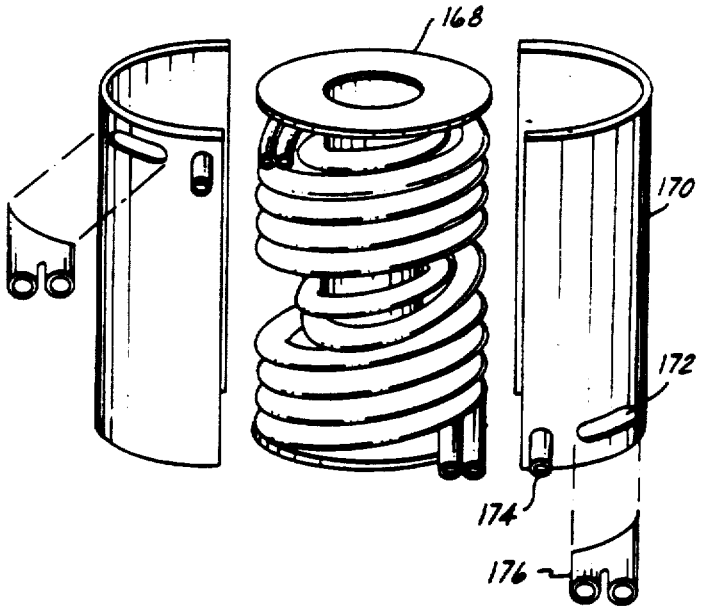
FIG. 17 is a perspective view of the first embodiment of the invention prior to assembly of the shell outer wall.

The spool-like assembly 168 which consists of an inner tube top and bottom plates and the coils are then fitted with the outer shell walls as shown in FIG. 17. The outer shell walls are made up of two identical semi-cylindrical halves 170 which are provided with a slot 172 through which the ends of the coils may project in an inlet/outlet fitting 174. The two semi-cylindrical halves are welded to the top and bottom plates and to each other. Yokes 176(*a*) and 176(*b*) are then welded to the tubes projecting through slot 172 and through the shell in a leak-tight manner. Note that the yokes used have individual outlets for each of the tubes forming the coil assembly, however, it may be more convenient in some instances to have a single outlet. With the yokes welded on the unit comes complete and it is then pressure tested for leaks and attachment brackets as desired are affixed to the outer shell.

The semi-cylindrical shell halves 170 employed in the preferred embodiment of the invention are constructed of steel tubing which has been cut and split. The tubing has an ⅛ nominal wall thickness and it is relatively easy to fabricate and weld. In high volume production, it is envisioned that the shell halves could be stamped or rolled with the yoke integrally formed therein.

Embodiment III

Figure 18:
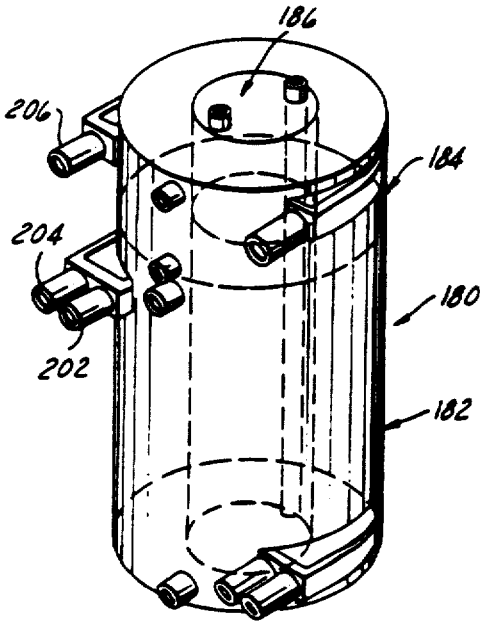
FIG. 18 is a perspective view of another alternative embodiment of the invention.
Figure 19:
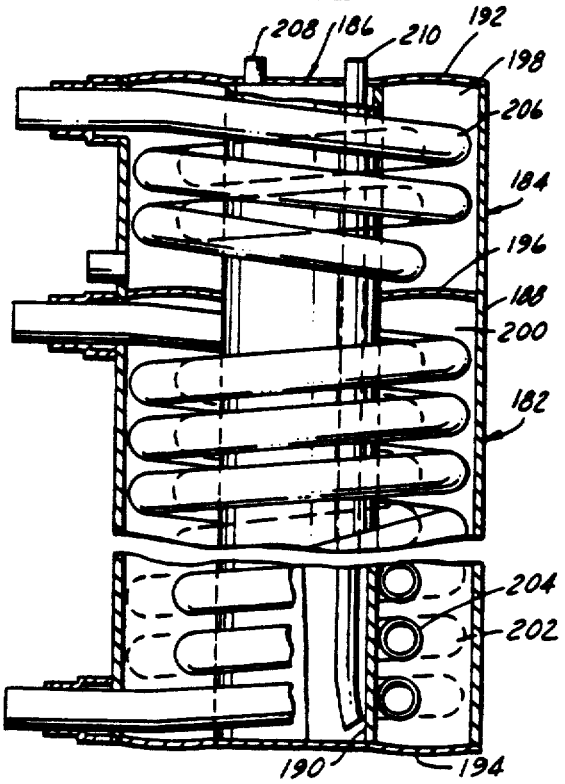
FIG. 19 is a side elevation of the heat exchanger of FIG. 18 with a portion of the shell cut away.

Another alternative embodiment of the invention is shown in FIGS. 18 and 19. This third embodiment 180 consists of a lower shell and coil heat exchanger assembly 182 and upper shell and coil heat exchanger 184 and a central receiver 186. The lower shell and coil heat exchanger 182 is similar in construction to the first embodiment shown in FIGS. 1 through 6 and previously described. The upper shell and coil heat exchanger 184 is mounted coaxially with the lower shell and coil heat exchanger 182 and utilizes a common outer tubular wall 188 and a common inner tubular wall 190. The third embodiment of the invention is provided with a top and bottom endplate, 192 and 194 and a divider plate 196 which separates the shell cavity into two independent fluid-tight cavities, upper cavity 198 and lower cavity 200. Within the lower cavity is a pair of spiral coils 202 and 204 and within the upper cavity is a single spiral coil 206.

There are a number of applications when multiple heat exchangers are needed in a system and the third embodiment of the invention shown in FIGS. 18 and 19 provides two heat exchangers in a very small compact assembly. Depending on the situation divider plate 196 may be left out thereby forming a single shell cavity in which both coil assemblies are housed. Heat exchangers of the present design are useful when a desuperheater is desired. Desuperheaters are also well known in the art and are used in situations when it is desirable from an efficiency standpoint to reduce the presser head pressure by providing supplemental cooling of the refrigerant. The top coil is also quite useful in residential dual mode heat pump systems where hot water will be heated or preheated by the heat pump. In the case of a hot water system or other device used with potable water, the coil is formed of a double walled tube for the purpose of detecting leaks. Whenever you are using potable water in conjunction with a refrigerant, it is important to detect leaks so that Freon® is not introduced into water intended for human consumption. Double wall tube of the type made by Noranda Metal Industries, Inc. of Newton, Conn. 06470 and referred to as a leak-detection double augmented tube (LDDA Series) works quite satisfactorily when combined with an appropriate leak sensor and shut-off or warning system.

The third embodiment of the invention as shown is also provided with an internal receiver 186 defined by inner tube wall 190 and top plate 192 and bottom plate 194. Note that unlike a first embodiment of the invention, the top and bottom plates enclose the ends of the inner tubular wall to form a fluid tight cylindrical cavity. The receiver is provided with an inlet 208 and an outlet 210 projected through the top plate 192. Outlet 210 preferrably is in the form of an elongated tube and extending into the receiver cavity and terminating near the bottom thereof. Receivers are quite frequently used in refrigerant systems and the present embodiment provides a compact receiver with minimal extra cost. It is important to note that there will in fact be some heat transfer between the fluid contained in the receiver and the fluid in the shell cavity to heat transfer through the inner shell wall. This heat transfer can be managed in some situations and likewise can be a detriment when no heat transfer is desired. When no heat transfer is desired, it is possible to install an additional receiver tube slightly smaller in outside diameter than the inside diameter of the inner shell wall thereby providing an airgap insulation separating the receiver cavity from the rest of the device.

The coil used in the second embodiment of the invention is somewhat easier to fabricate since both coils are uniform in diameter. The apparatus shown in FIG. 14 used for the winding of the coil used in the first embodiment can also be used to wind the coil and the second embodiment. The mandrel 110 is provided with a series of axially spaced apart drilled and tapped holes 150 for the attachment of clamp 148 at various axial positions along the mandrel. As shown in FIG. 14, clamp 148 is attached in the extreme leftmost position, a position that would be used for forming a constant diameter coil of the type shown in FIG. 9. When a dual diameter coil is to be formed of the type shown in FIG. 15, clamp 148 would be attached to the mandrel 110 and the center portion of the large diameter region so that half of the coil windings will be formed on the large diameter region and half on the small diameter region. Two coils are formed with the desired number of turns and then they are threadingly fitted into each other. It may be necessary to press the unit axially to the desired length to achieve a specific axial tube space, however, pressing may not be necessary if the axial clearance ratio can be adequately established by varying the inside or outside shell wall diameter.

It will also be understood, of course, that while the form of the invention herein shown and described constitues a preferred embodiment of the invention, it is not intended to illustrate all possible forms thereof. It will be understood that the words used are words of description rather than limitation and various changes may be made without departing from the spirit and scope of the invention disclosed.

I claim:

1. A heat exchanger comprising:

a shell having: a tubular outer wall having a first and second end, a tubular inner wall having a first and second end coaxial with said outer wall, and first and second end plates attached to the first and second ends of the outer and inner walls to form an enclosed tubular shell cavity therebetween having a first and second end;

means for admitting a first fluid into said shell cavity;

means for removing the first fluid from the shell cavity;

a spiral coil of tubing having a first and second end sealingly exiting through the shell cavity wall for carrying a second fluid therebetween, said spiral coil lying within the shell cavity and having a plurality of spiral windings formed about the axis thereof, the spiral coil sized to fit between the inner and outer shell wall with limited radial clearance to allow limited axial flow of the first fluid, said winding axially spaced from one another to define a spiral flow path therebetween for the first fluid, said radial clearance and axial spacing relatively sized to induce the first fluid to travel in a substantially spiral motion to enhance the heat transfer between the first and second fluids;

an auxiliary coil of tubing having a first and second end sealing extending through the shell cavity for carrying a third fluid therebetween, said auxiliary coil lying within the shell cavity and having a plurality of windings formed about the axis thereof and axially spaced apart from the spiral coil, for transferring heat between the first and third fluids; and a divider plate dividing the shell cavity into two coaxial cylindrical regions, a primary region in which lies the spiral coil and an auxiliary region in which lies the auxiliary coil, and means to admit and means to remove a fourth fluid from the auxiliary region.

2. The invention of claim 1 wherein the shell cavity provides a path for the flow of the first fluid, said path has an axial flow area when viewed parallel to the axis and a spiral flow area when viewed parallel to a line tangent to the coil tube, where said axial flow area divided by the spiral flow area defines an axial clearance ratio which is less than 1.0.

3. The invention of claim 2 wherein the axial clearance ratio is greater than 0.05.

4. The invention of claim 2 wherein the axial clearance ratio falls within a range of 0.25 to 0.60.

5. The invention of claim 1 wherein said spiral coil is formed of a tube having at least one augmented wall surface to maximize surface area and heat transfer.

6. The invention of claim 1 wherein said tube is formed of copper.

7. The invention of claim 1 further comprising a fluid receiver formed within the volume bounded by the shell inner tube wall and the first and second end plates, said receiver further provided with means for admitting and means for removing fluid from the enclosed receiver volume.

8. The invention of claim 1 further comprising a fluid receiver formed within the volume bounded by the shell inner tube wall and the first and second end plates, said receiver further provided with means for admitting and means for removing fluid from the enclosed receiver volume.

* * * * *

UNITED STATES PATENT AND TRADEMARK OFFICE

CERTIFICATE OF CORRECTION

PATENT NO. : 5,228,505
DATED : July 20,1993
INVENTOR(S) : Jack C. Dempsey

It is certified that error appears in the above-indentified patent and that said Letters Patent is hereby corrected as shown below:

On the title page: Item [56]

U.S. Patent Documents, after "4,402,359 9/1983" replace "Carnaous" with --Carnauos --.

Column 3, line 32, replace 'would" with --wound --;

Column 10, line 28, replace 'in" with --is --.

Column 10, line 56, after "1/8" insert --inch --.

Signed and Sealed this

Sixteenth Day of May, 1995

Bruce Lehman

*Attest:*

BRUCE LEHMAN

*Attesting Officer*

*Commissioner of Patents and Trademarks*